US006880281B1

(12) United States Patent
Orr

(10) Patent No.: US 6,880,281 B1
(45) Date of Patent: Apr. 19, 2005

(54) ADJUSTABLE TRIGGER STOP

(76) Inventor: Jeffrey George Orr, 252 Granite St., Corona, CA (US) 92879

( * ) Notice: Subject to any disclaimer, the term of this patent is extended or adjusted under 35 U.S.C. 154(b) by 60 days.

(21) Appl. No.: 10/386,626

(22) Filed: Mar. 12, 2003

Related U.S. Application Data

(60) Provisional application No. 60/364,209, filed on Mar. 13, 2002.

(51) Int. Cl.[7] ..... F41A 17/22

(52) U.S. Cl. ..... 42/70.01; 42/69.01

(58) Field of Search ..... 42/66, 69.01, 70.01, 42/70.04, 70.05, 70.06, 70.07; 89/27.12, 142, 148, 149, 150

(56) References Cited

U.S. PATENT DOCUMENTS

| | | | | | |
|---|---|---|---|---|---|
| 2,453,683 | A | * | 11/1948 | Caldow | 42/70.04 |
| 2,563,720 | A | * | 8/1951 | Guisasola | 42/70.02 |
| 4,133,128 | A | * | 1/1979 | Brush | 42/70.01 |
| 4,282,795 | A | * | 8/1981 | Beretta | 89/148 |
| 4,589,327 | A | * | 5/1986 | Smith | 89/148 |
| 4,679,487 | A | * | 7/1987 | Houseman | 89/140 |
| 5,068,990 | A | * | 12/1991 | Marzocco | 42/70.04 |
| 5,149,898 | A | * | 9/1992 | Chesnut et al. | 42/69.01 |
| 5,251,533 | A | * | 10/1993 | Layton | 89/142 |
| 5,596,162 | A | * | 1/1997 | Burns | 89/128 |
| 5,635,663 | A | * | 6/1997 | Krieger et al. | 89/142 |
| 5,718,074 | A | * | 2/1998 | Keeney | 42/69.03 |
| 5,760,328 | A | * | 6/1998 | Robbins | 89/129.02 |
| 5,799,434 | A | * | 9/1998 | Krieger et al. | 42/69.03 |
| 6,212,812 | B1 | * | 4/2001 | Aigner | 42/70.06 |
| 6,223,460 | B1 | * | 5/2001 | Schmitter et al. | 42/70.06 |
| 6,256,917 | B1 | * | 7/2001 | Findlay | 42/70.06 |
| D458,333 | S | * | 6/2002 | Power | D22/108 |
| 6,494,194 | B2 | * | 12/2002 | Shipachev et al. | 124/73 |
| 6,629,379 | B1 | * | 10/2003 | Doiron | 42/70.11 |
| 6,705,036 | B2 | * | 3/2004 | Orr | 42/69.01 |

* cited by examiner

*Primary Examiner*—Michael J. Carone
*Assistant Examiner*—John Richardson
(74) *Attorney, Agent, or Firm*—Keisling Pieper & Scott PLC; David B. Pieper; Trent C. Keisling

(57) ABSTRACT

An adjustable trigger stop assembly comprises a first generally cylindrical lateral arm having an inner end and an outer end and a second generally cylindrical lateral arm having an inner end and an outer end. The first and second lateral arms each have an aligned axis, with the inner ends of the first and second lateral arms respectively facing each other. An intermediate portion is formed on the axis between the inner ends of the first and second lateral arms respectively. The intermediate portion has at least a first facet spaced from the axis and a second facet spaced from the axis, the first and second facets in use engaging a trigger so that each facet permits different amounts of movement of the trigger.

11 Claims, 3 Drawing Sheets

FIG. 3
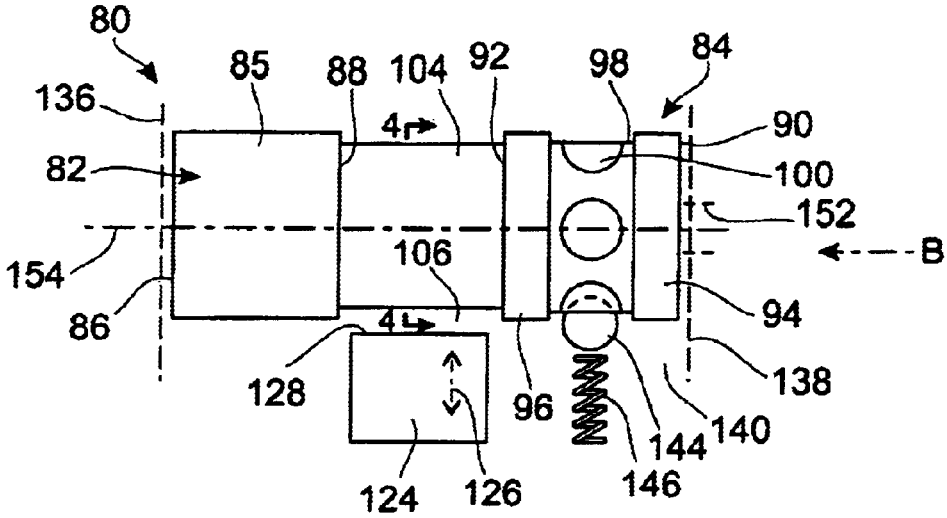
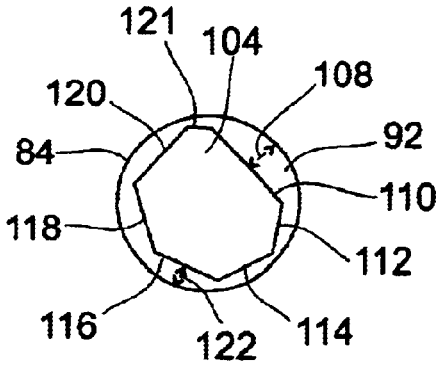
FIG. 4
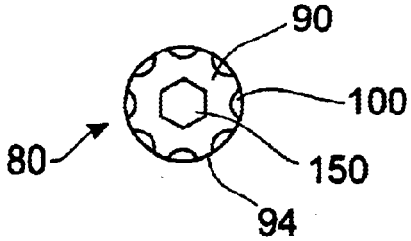
FIG. 5
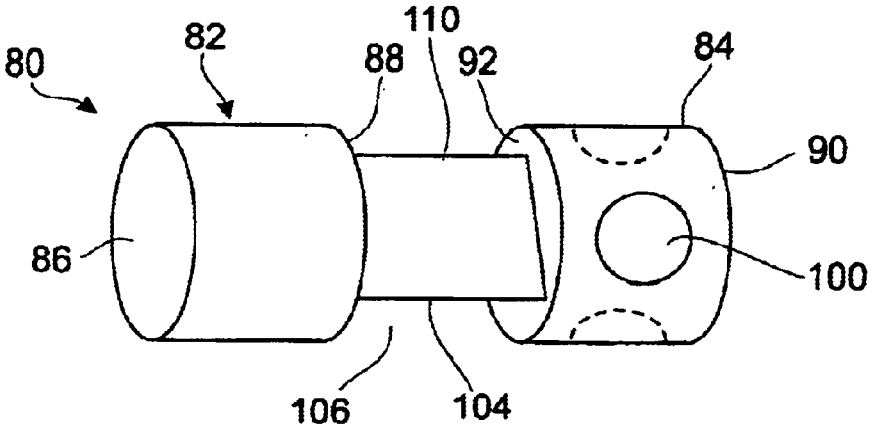
FIG. 6

ADJUSTABLE TRIGGER STOP

CROSS-REFERENCE TO RELATED APPLICATIONS

This application claims the benefit of U.S. Provisional Application No. 60/364,209 filed Mar. 13, 2002, which is incorporated herein in its entirety.

FIELD AND BACKGROUND OF THE INVENTION

This invention relates to adjustable trigger stops for guns, and has a particular application with respect to trigger stops used in paintball guns, also known as paintball markers.

In this specification, it should be understood that the word "trigger stop" is used to denote a component in a gun, such as a paintball gun or marker, whose position can be adjusted or varied to place a lock or bar against activation of the firing mechanism. The trigger stop, also known by other names such as a catch, is a broad term used in this document to indicate any physical mechanism which has the effect of locking the weapon. The trigger stop of the invention can also be used to adjust or vary the "travel" of the trigger so that the user can set this parameter for desired speed of firing.

Trigger stops, or catches, which can be fastened or released to jam the firing mechanism and prevent accidental of the weapon, are common components, and are found on almost all types of guns. They can also be found on paintball markers.

Typically, and with respect to paintball markers, the operator fires the weapon by the activation of the firing mechanism. This is initiated by pulling on a trigger. The movement of the trigger, which is in contact with a sear or a pivotal lever adjacent the trigger, causes the sear to move, or pivot about a rotating point. This movement, or pivoting of the sear, eventually results in the release of a hammer, which in turn strikes a valve in the paintball marker to open airflow pathways to produce sufficient force to effect the discharge of the paintball loaded in the paintball marker.

Conventional trigger stops or catch systems use stops which are in some way configured to prevent movement of the trigger, and to thereby stop pivoting of the sear, when in the locked position, and thus jam the firing mechanism to ensure that the weapon will not be inadvertently activated and cause injury when a paintball is discharged.

With particular reference to paintball markers, conventional catches or trigger stops usually comprise small barrel-shaped objects which are mounted in the vicinity of the trigger or sear, and have an axis which is transverse or normal to the barrel of the paintball marker. This arrangement is also common for a conventional weapon. This catch is movable between a first position, where it permits unobstructed movement of the sear and/or trigger, and a second position, where the stop directly engages the trigger or sear so that further movement thereof is prohibited. In the second position, the gun is therefore locked and cannot be fired.

One potential problem associated with conventional trigger stops or catches is that the barrel-shaped object which comprises the trigger stop projects outwardly from the trigger frame, or other portion of the paintball marker or gun, presenting itself as a small button, which can be pushed from one direction or another so as to move the catch into the first or second position for locking or unlocking the mechanism. Such catches may be inadvertently knocked so as to move them from the locked to the unlocked position, causing a potentially dangerous situation. Further, these trigger stops may indeed be manipulated to the unlocked position by children or inexperienced users, once more causing unlocking of the firing mechanism and creating a dangerous situation.

SUMMARY OF THE INVENTION

According to one aspect of the invention, there is provided an adjustable trigger stop assembly comprising a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other; and an intermediate portion formed on the axis between the inner ends of the first and second lateral arms respectively, the intermediate portion having at least a first facet spaced from the axis and a second facet spaced from the axis, the first and second facets for engaging a trigger so that each permits different amounts of movement of the trigger.

According to another aspect of the invention, there is provided an adjustable trigger stop assembly for controlling the extent of movement of a trigger in a paintball marker with which it is associated, the trigger stop assembly comprising: a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other; and an intermediate portion formed on the axis between the inner ends of the first and second lateral arms respectively, the intermediate portion having a plurality of facets arranged circumferentially on the intermediate portion, each facet stopping movement of the trigger to end the trigger stroke, each facet being differently spaced from the axis to permit a different trigger stroke.

The invention in one aspect is for a trigger stop mechanism with enhanced safety and/or operational features. The trigger stop mechanism of the invention allows for the more effective locking and unlocking of the trigger stop which would improve the safety characteristics of the weapon, and particularly a paintball marker. Further, the trigger stop mechanism, by its design features and configuration, also allows the user of the paintball marker to make adjustments to the position and effect of the trigger stop mechanism which varies the firing process by determining the rapidity of paintballs fired from the marker in a given period.

In one aspect, therefore, the invention relates to a trigger stop for use in a weapon, particularly a paintball gun, comprising a pair of lateral portions, and an intermediate portion, the intermediate portion being multi-faceted so that any one facet creates a recess with respect to the two lateral portions which recess differs in configuration from other recesses formed by other facets of the intermediate portion. The size of the recess, when the trigger stop is associated with a corresponding sear, determines the extent of movement of the sear, and thus the locked or unlocked condition of the weapon.

Preferably, the trigger stop is locked and unlocked by the rotation thereof, and recesses are provided in one portion to receive detents to secure the trigger stop in a radial or angular position.

BRIEF DESCRIPTION OF THE DRAWINGS

Reference is now made to the accompanying drawings, which help to describe and illustrate the invention.

FIG. 3 is a front view of the trigger stop of the invention, with certain related components illustrated;

FIG. 4 is a cross-section along lines 4—4 in FIG. 3 of the drawings;

FIG. 5 is an end view of the trigger stop of the invention as shown in FIG. 3 of the drawings, viewed from the direction of arrow B therein;

FIG. 6 is a perspective view of a trigger stop of the invention, as shown in FIG. 3 of the drawings;

DETAILED DESCRIPTION OF THE INVENTION

The invention relates to a trigger stop assembly for use in a weapon, and particularly a paintball gun. The trigger stop assembly comprises a pair of lateral substantially cylindrical portions, and an intermediate portion therebetween. The intermediate portion is multi-faceted so that any one facet creates a recess with respect to the two lateral portions which recess differs in its configuration and characteristics, especially depth with respect to the lateral portions, from other recesses formed by other facets of the intermediate portion. The size of the recess, when the trigger stop is associated with a corresponding sear, determines the extent of movement of the sear, and thus the locked or unlocked condition of the weapon.

The size of the recess will also have an effect in determining the rate at which paintballs are discharged from the paintball marker, since the depth of the recess directly controls the stroke length of the associated trigger. Depending upon the stroke length selected by appropriate adjustment of the trigger stop assembly, the paintball marker will fire either more rapidly or more slowly.

The trigger stop assembly is locked and unlocked by the rotation thereof, and recesses are provided in one portion of the trigger stop assembly to receive detents to thereby secure the trigger stop in a radial or angular position.

Figure 1:
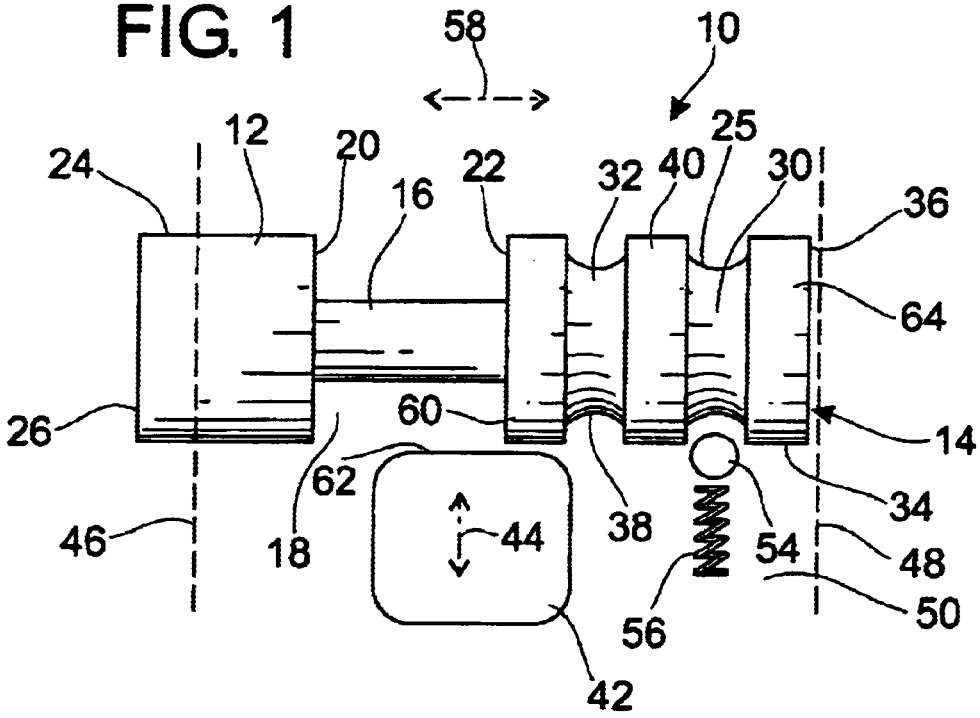
FIG. 1 is a front view of a conventional or standard trigger stop or safety catch, and certain related components.
Figure 2:
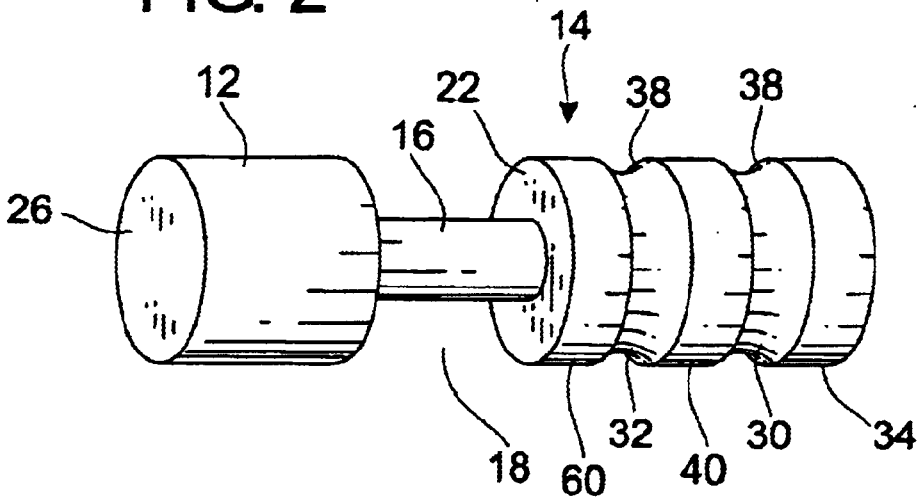
FIG. 2 is a perspective view showing the cylindrical shape of the catch as shown in FIG. 1 of the drawings.

Reference is now made to FIGS. 1 and 2 of the drawings, showing a front view and perspective view respectively of a conventional trigger stop. In FIG. 1, a trigger stop 10 comprises a first lateral portion 12 and a second lateral portion 14. Both the first and second lateral portions 12 and 14 are essentially cylindrical in shape. The lateral portions 12 and 14 are connected to each other by an intermediary portion 16, also cylindrical in shape, and having a diameter substantially less than the first and second lateral portions 12 and 14. In the embodiment shown in FIG. 1, the diameter of the intermediary portion 16 is approximately one third of the diameter of each of the first and second lateral portions 12 and 14.

The intermediary portion 16 defines a recessed channel 18 between an inner wall 20 of the first lateral portion 12 and an inner wall 22 of the second lateral portion 14.

The first lateral portion 12 generally has a smooth cylindrical outer surface 24, and a flat-faced outer wall 26. The second lateral portion 14 has somewhat more axial length than the first lateral portion 12. A first circumferential groove 30 and a second circumferential groove 32 are formed in the outer surface 25 of the second lateral portion 14. The second lateral portion 14 has a flat-faced outer wall 36.

The first and second circumferential grooves 30 and 32 each define shallow arcs 38, and a flat middle portion 40 is formed between them.

FIG. 1 also shows the position of a sear 42, which is pivotally mounted within the gun, and capable of up and down movement about the pivot in the direction generally indicated by arrow 44.

The trigger stop 10 is transversely mounted within a trigger frame, shown in phantom lines 46 and 48, which defines a space 50. The sear 42 is pivotally mounted in the space 50, which comprises a chamber within the trigger frame.

A fixed position detent 54, which is generally urged upwardly by spring 56, is located within the space 50, and is adapted to engage one of the shallow arcs 38 formed by the first and second circumferential grooves 30 and 32 respectively, depending upon the position of the trigger stop 10, as will be described.

The trigger stop 10 is movable in a reciprocating transverse direction, indicated by direction arrow 58. In the position of the trigger stop 10 shown in FIG. 1 of the drawings, the paintball marker or weapon is in the locked position. As will be seen, an engaging surface 60 of the second lateral portion 14 allows no, or relatively little, up and down movement (see reference numeral 44) of the sear 42, since the upper surface 62 of the sear 42 abuts against the engaging surface 60. In this position, the detent 54 is accommodated in the first circumferential groove 30 which prevents accidental transverse movement of the trigger stop 10 towards the right hand position, as represented by the arrow 58.

The locked position of the trigger stop 10 shown in FIG. 1 of the drawings can be changed to an unlocked position by applying pressure on the outer wall 26 of the first lateral portion 12. A sufficient force will permit the detent 44 to slide out of the shallow arc 38 of the first circumferential groove 38, over the flat middle portion 40, and into the second circumferential groove 32, where it is once more able to lock. As will be appreciated, the bias of the spring 56 causes upward movement of the detent 44 into the first or second circumferential grooves 30 and 32 to keep the trigger stop 10 in a locked position until a sufficiently large force is applied to overcome this bias.

In the unlocked position, the outer wall 26 will become flush, or substantially flush, with the trigger frame wall, represented by the reference numeral 46. At the same time, the flat outer portion 64 will move out from the space 50, beyond, or to the right of, the trigger frame as represented by the wall 48, and project outwardly thereof. The engaging surface 60 will also move, so that the sear 42 will be free to move in an up and down direction, as indicated by arrow 44, in to and out of the recessed channel 18. Thus, in this unlocked position, the sear 42 would be able to move into the recessed channel 18, which would allow sufficient movement of the sear to release a hammer, which sets off the remainder of the firing operation.

It will be appreciated that the trigger stop 10 shown in FIG. 1 can be moved back and forth to lock and unlock the sear 42, and prevent inadvertent firing of the weapon when in the locked position.

Reference is now made to FIG. 3 of the drawings which shows a trigger stop 80 of the invention. The trigger stop 80 comprises a first lateral portion 82 and a second lateral portion 84. The first and second lateral portions 82 and 84 are substantially cylindrical in shape, and have substantially the same diameter. The first lateral portion 82 has a smooth cylindrical outer surface 85, a smooth end surface 86, and an inner surface 88.

The second lateral portion 84 has a flat end surface 90 and an inner surface 92. Further, the second lateral portion 84 has a substantially smooth outer strip 94 and a substantially smooth inner strip 96. A median strip 98 is formed between the outer and inner strips 94 and 96, and incorporates a plurality of detent recesses 100 formed therein. Preferably, each detent recess 100 comprises an arcuate shallow structure, best illustrated in FIG. 5 of the drawings, and each of the detent recesses 100 are of substantially the same size and arranged more or less equidistantly along the diameter of the median strip 98.

An intermediate portion 104 is formed between the first and second lateral portions 82 and 84, extending between the inner surface 88 of the first lateral portion 82 and the inner surface 92 of the second lateral portion 84. The intermediate portion 104 is a multi-faceted bar, having a series of differently angled and dimensioned flat surfaces, as best seen in FIG. 4, which is a cross-section through the trigger stop 80 along line 4—4. While FIG. 4 shows seven faces, the invention is not limited to this number and any desired number of faces can be used to achieve specific or preferred configurations.

The intermediate portion 104 defines a recessed chamber 106 between the inner surface 88 and inner surface 92 of the first and second lateral portion 82 and 84 respectively. The extent of this recessed chamber 106 varies according to the configuration of the multi-faceted intermediate portion 104. This is best illustrated in FIG. 4 of the drawings. In FIG. 4, there is shown, in cross-section, the intermediate portion 104, and the second lateral portion 84. The intermediate portion 104 includes flat face 110. The recessed chamber 106 provided at that position of the intermediate portion 104, where the flat face 110 is located, is represented by arrow 108.

In all, the intermediate portion 104 has seven flat faces 110, 112, 114, 116, 118, 120 and 121. The position of these each flat faces results in a different sized recessed chamber 106. As an example, flat face 116 defines a recessed chamber 106 indicated by reference arrow 122. This recessed chamber 106 indicated by arrow 122 is significantly smaller than that provided by flat face 110, as indicated by arrow 108. Each flat face 110 to 121, being of different profile and configuration, will create a recessed chamber 106 with respect to the first and second lateral portions 82 and 84 respectively, and the significance thereof will be discussed further below.

A sear 124 is illustrated in schematic form in FIG. 3 of the drawing and is pivotally mounted and capable of up and down movement, as indicated by arrow 126. The upper surface 128 of the sear 124 is generally located between the inner surfaces 88 and 92, and capable of extending into the recessed chamber 106. However, the degree and extent to which the upper surface 128 of the sear 124 can move within the recessed chamber 106 clearly depends upon the size of the recessed chamber, and the size thereof is determined by the angular or circumferential position of the trigger stop 80, and the particular construction of the flat face (110–121) which is presented to the sear 124.

The trigger stop 80 is mounted within a trigger frame 180 (see FIG. 7), shown schematically in FIG. 3 between side wall 136 and side wall 138. The two side walls 136 and 138 define a space 140 which is the chamber in which, amongst other components, the trigger stop 80 is mounted. It will be noted that, unlike the more conventional trigger stop 10 illustrated in FIG. 1 of the drawings, the trigger stop 80 of the invention does not slide axially in a transverse direction. Rather, the trigger stop 80 is wholly contained within the side walls 136 and 138, with the end surface 86 falling just within the side wall 136 of the first lateral portion 82, and the end surface 90 falling just within the side wall 138 of the second lateral portion 84.

Within the space 140, there is mounted a detent 144, which is generally urged upwardly by spring 146. The detent 144 is shaped so as to be received within one of the detent recesses 100 formed on the middle strip 98 of the second lateral portion 84. The detent 144 comes to rest within a substantially correspondingly shaped recess chamber 100 formed in the outer surface of the median strip 98. The effect of the detent 144 in the recess chamber 100 is to lock the trigger stop 80 in an angular position, until sufficient force is been applied so as to move the trigger stop 80 (as will be described) and thereby overcome the upward force of the spring 146 on the detent 144 in the recess chamber 100.

FIG. 5 of the drawings shows a view of the trigger stop 80 from one end thereof as shown by the direction of arrow B. FIG. 5 shows the side view of the trigger stop 80 including the end surface 90, the surface of the outer strip 94, and a plurality of recess chambers 100, eight of which are shown in the embodiment in FIG. 5, configured in the median scrip 98. FIG. 5 also shows a centrally located hexagonal slot 150. In practice, this slot 150 is accessible from outside of the space 140 through an aperture 152 in side wall 138.

Figure 7:
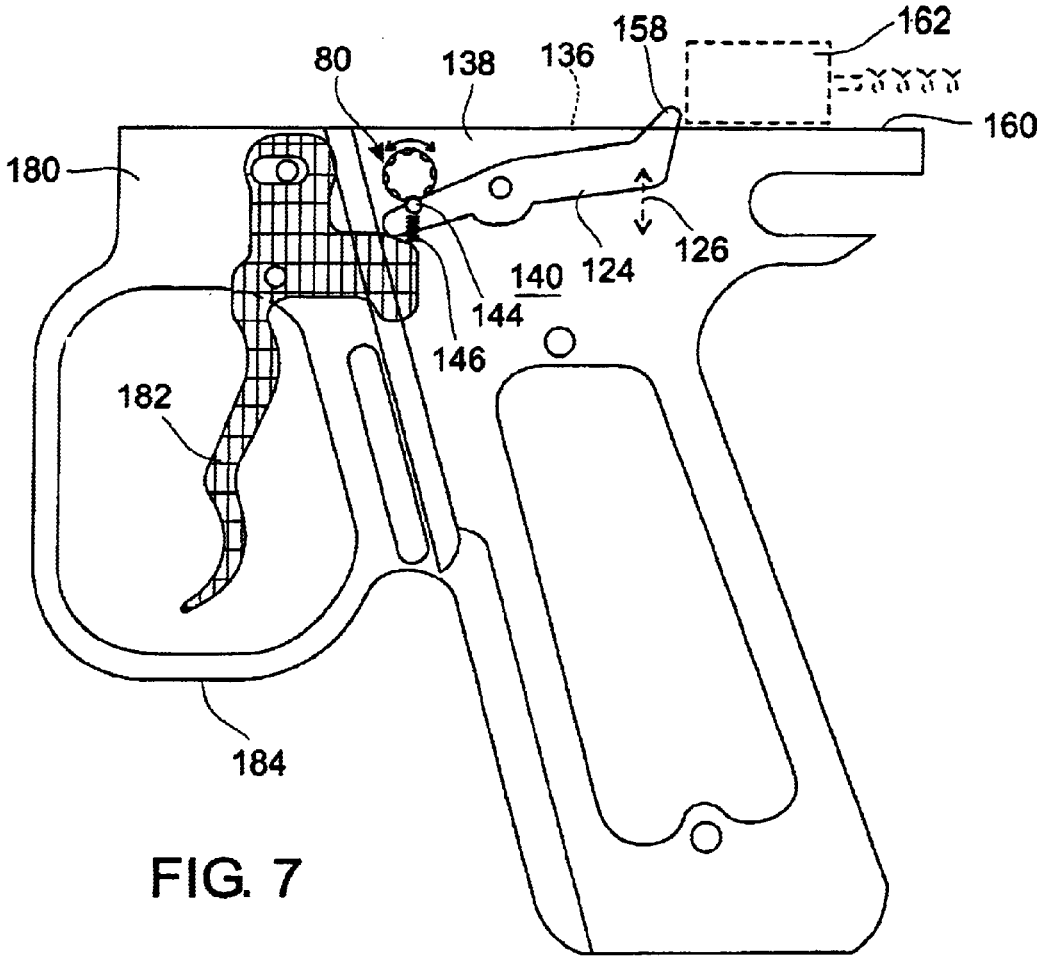
FIG. 7 is a side view of a trigger frame, showing the trigger and sear, as well as the trigger stop of the invention in relation thereto.
Figure 8:
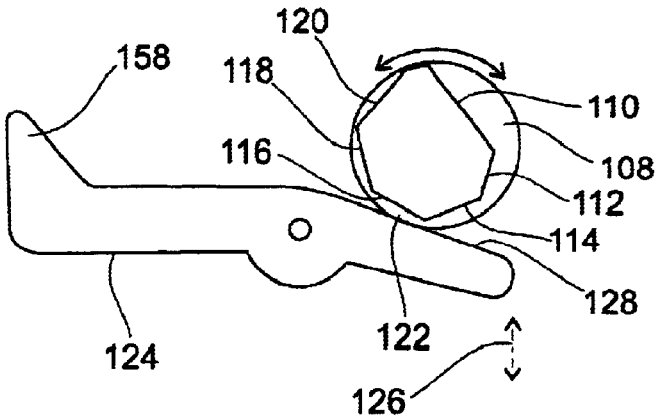
FIG. 8 is a detailed side view of the trigger stop of the invention shown with the sear, and its relationship thereto.

The trigger stop 80 is moved between a locked and an unlocked position by rotating it about its axis 154, indicated by phantom line 154. Such movement is effected by inserting an Allen wrench, or hex key, through the aperture 152, and into the hexagonal slot 150. The Allen key is used to then rotate the trigger stop 80, either clockwise or counterclockwise, and a good representation of this movement can be seen with reference to FIG. 8 of the drawings. As the Allen key is rotated, so the entire trigger stop 80 is rotated with it. As the trigger stop 80 is rotated, the various faces 110–120 also rotate, and, as mentioned above, the size of the recessed chamber 106 will vary depending upon the position and location of any one face. For example, FIG. 8 of the drawing shows the face 116 near the sear 124, creating a small space 122. In this position, the sear 124 will have very limited pivotal movement, and will essentially be barred from rotation about its pivot point. In this position, the paintball will therefore be prevented from firing a paintball, i.e. in a locked or safe condition. With reference to FIG. 7, it is important that the tail 158 of the sear 124 drop below the plane 160, which will allow the hammer 162 to move forward. With the trigger stop 80 arranged in the position shown in FIG. 8, this will not be possible.

However, upon rotation of the trigger stop 80 by means of the Allen key in the hexagonal slot 150, the movement of the trigger stop 80 caused thereby will eventually result in the presentation of face 110 to the upper surface 128 of the sear 124. This face 110 falls well within the outer circumference of the first and second lateral portions 82 and 84, creating a bigger recess chamber 106, and thereby permitting further upward movement of the sear 124. Upward movement of the sear 124 at its point adjacent the trigger stop 80 is thus permitted, and the tail 158 of the sear 124 can then drop below the plane 160, allowing the hammer 162 to advance. Ultimately, the hammer 162 moves forward, and its momentum opens a valve, initiating the flow of compressed air through the pathways to discharge the paintball from the paintball marker.

As the trigger stop 80 is rotated, it moves into fixed, holding positions, when the detent 144 inserts in one of the detent recesses 100. Of course, the position of any one of the faces 110–121 would be constructed so as to be in an appropriate position for use, and the particular relationship of one of the faces 110–121 with a corresponding detent recess 100 for locking that face in the optimal position would be taken into account in configuring the trigger stop 80.

FIG. 7 shows the position of the trigger stop 80 within the trigger frame 180. Also shown in the trigger frame 180 is the trigger 182 mounted within the trigger guard 184. The trigger 182, when pivoted, causes rotation of the sear 124, and results in its up and down movement, as represented by the reference numeral 126. Such movement of the sear 124 in turn controls release of the hammer 162. The trigger stop 80 is shown in FIG. 7, and depending on its angular position will either allow the sear 124 to rotate about its pivot and fire a paintball from the paintball marker, or fix the sear 124 to prevent such rotation thereof about its pivot point and thus lock the firing mechanism to prevent discharge of a paintball.

One difference of the trigger stop 80 of the invention over the conventional trigger stop 10 shown in FIG. 1 of the drawings is the ability to allow different extents of movement of the sear 124 according to the angular position of the trigger stop 80. In conventional systems, with the transverse sliding of the trigger stop 10 as shown in FIG. 1, the sear 42 is either locked or unlocked. Thus, the sear is either incapable of rotation and movement, or fully capable of such movement, to initiate the firing mechanism. There is no "in-between" position at which the sear 42 would be allowed different extents of movement.

In the trigger stop 80 of the invention, the positioning and configuration of the various faces 110 to 121, allows the user to set the trigger stop 80 so that the sear 124 is capable of no movement, all movement necessary to effect firing, or various in-between states.

The trigger stop 80 of the invention also allows the user to determine the trigger travel distance and thus adjust the speed at which the weapon is tired. For example, the trigger stop 80 may be rotated such that the trigger 182 moves a greater distance or a lesser distance, according to the face 110 to 121 facing the sear 124 or trigger 182. When a selected face 110 to 121 reduces the size of the recess chamber 106, without actually locking the trigger 182 to prevent firing, the trigger 182 will move less or have a shorter stroke. This facilitates more rapid firing sequences. On the other hand, when a face 110 to 121 is selected such that the size of the recess chamber 106 is increased, this will have the effect of increasing the stroke of the trigger 182 and make successive firings of the weapon further apart in terms firing rate. The trigger stop 80 of the invention thus not only permits improved locking ability and hence weapon safety, but also provides the mechanism for selecting the trigger stroke to vary the firing rate, as desired and as allowed based on the parameters and configuration of the trigger stop 80 and the position of the faces 110 to 121 thereon. Depending upon the number of faces 110 to 121 on the intermediate portion 104, the adjustment increments in selecting trigger stroke will be higher (for more faces) and lower (for fewer faces).

The trigger stop 80 of the invention has a number of significant advantages. First, it is mounted wholly within the space 140, and does not, or need not, project from the trigger frame. Thus, the trigger stop 80 of the invention does not present an external "button" or projection which can be pressed to lock and unlock the firing mechanism. This "button" arrangement may be problematical in that children may be able to unlock the paintball marker firing mechanism, or the paintball marker may fall on the button, moving it to an unlocked position. In the trigger stop 80 of the invention, this cannot happen, since there is no transverse movement of the trigger stop 80. The trigger stop 80 is moved between the unlocked and locked positions by rotating it, and a special tool (an Allen or hex key) is required to do this. The safety levels that are achieved, therefore, using the trigger stop 80 of the invention are substantially enhanced.

Second, the construction of faces 110 to 121 into the intermediate portion 104 allows for the user to select within prescribed limits the trigger stroke or travel distance and thus the firing rate of the weapon. This option is available where faces 110 to 121 between the complete "lock" face (116) and the complete "unlock" face (110) are selected by the user by rotating the trigger stop 80 to one of the intermediate positions provided by the remaining faces (112, 114, 118, 120).

The trigger stop 80 of the invention may be incorporated into new paintball markers, or existing paintball markers may be appropriately adapted for inclusion of this component. Note that the concept of the trigger stop assembly of the invention may be used in weapons other than paintball markers, and it should be understood that the invention is not limited to the application of paintball markers.

It is to be noted that the invention is not limited to the precise details described hereabove, and that many variations are possible.

What is claimed is:

1. An adjustable trigger stop assembly comprising:

a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other;

an intermediate portion formed on the axis between the inner ends of the first and second lateral arms respectively, the intermediate portion having at least a first facet spaced from the axis and a second facet spaced from the axis, the first and second facets for engaging a trigger so that each permits different amounts of movement of the trigger;

wherein the first facet is spaced a greater distance from the axis, and the second facet is spaced a lesser distance from the axis.

2. An adjustable trigger stop assembly comprising:

a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other;

an intermediate portion formed on the axis between the inner ends of the first and second lateral arms respectively, the intermediate portion having at least a first facet spaced from the axis and a second facet spaced from the axis, the first and second facets for engaging a trigger so that each permits different amounts of movement of the trigger;

wherein the first facet is spaced from the axis by a distance which causes engagement with the trigger to substantially lock the trigger and the second facet is spaced from the axis by a lesser distance than the first facet to unlock the trigger; and at least one additional facet spaced from the axis a distance intermediate that of the first and second facets from the axis.

3. An adjustable trigger stop assembly as claimed in claim 2 wherein there are four additional facets on the intermediate portion.

4. An adjustable trigger stop assembly as claimed in claim 3 wherein the four additional facets are spaced from the axis to unlock a trigger, whereby each additional facet is configured so as to result in a different trigger stroke.

5. An adjustable trigger stop assembly comprising:

a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other;

an intermediate portion formed on the axis between the inner ends of the first and second lateral arms respectively, the intermediate portion having at least a first facet spaced from the axis and a second facet spaced from the axis, the first and second facets for engaging a trigger so that each permits different amounts of movement of the trigger; and a rotating mechanism whereby the adjustable trigger stop assembly can be rotated about the axis, wherein a selected radial position of the adjustable trigger stop assembly determines the facet which will be operational with respect to the trigger.

6. An adjustable trigger stop assembly as claimed in claim 5 wherein the rotating mechanism comprises a shaped aperture formed in the outer end of the first lateral arm.

7. An adjustable trigger stop assembly as claimed in claim 6 wherein the shaped aperture has an hexagonal shape.

8. An adjustable trigger stop assembly as claimed in claim 7 further comprising an hexagonal-shaped key for rotating the trigger stop assembly when engaged within the hexagonal-shaped aperture.

9. An adjustable trigger stop assembly comprising:

a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other;

an intermediate portion formed on the axis between the inner ends of the first and second lateral arms respectively, the intermediate portion having at least a first facet spaced from the axis and a second facet spaced from the axis, the first and second facets for engaging a trigger so that each permits different amounts of movement of the trigger;

wherein the intermediate portion defines a recess between the inner ends of the first and second lateral arms respectively the recess depth varying according to the distance between the facet and the axis; and wherein the recess is configured so as to receive a portion of a sear.

10. An adjustable trigger stop assembly for controlling the extent of movement of a trigger in a paintball marker with which it is associated, the trigger stop assembly comprising:

a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other;

an intermediate portion formed on the axis between the inner ends of the first and second lateral arms respectively, the intermediate portion having a plurality of facets arranged circumferentially on the intermediate portion, each facet stopping movement of the trigger to end the trigger stroke, each facet being differently spaced from the axis to permit a different trigger stroke; and wherein the intermediate portion defines a recess between the inner ends of the first and second lateral arms respectively, the recess depth varying according to the distance between the facet and the axis.

11. An adjustable trigger stop assembly for controlling the extent of movement of a trigger in a paintball marker with which it is associated, the trigger stop assembly comprising:

a first generally cylindrical lateral arm having an inner end and an outer end and a second generally cylindrical lateral arm having an inner end and an outer end, the first and second lateral arms each having an aligned axis, with the inner ends of the first and second lateral arms respectively facing each other;

an intermediate portion formed on the axis between the inner ends of the first and second lateral arms respectively, the intermediate portion having a plurality of facets arranged circumferentially on the intermediate portion, each facet stopping movement of the trigger to end the trigger stroke, each facet being differently spaced from the axis to permit a different trigger stroke; and wherein the plurality of facets comprises a first facet spaced from the axis by a distance which causes engagement with the trigger to substantially lock the trigger and a second facet spaced from the axis by a lesser distance than the first facet to unlock the trigger.

* * * * *